US007685850B2

(12) United States Patent
Nilsson

(10) Patent No.: US 7,685,850 B2
(45) Date of Patent: Mar. 30, 2010

(54) SECURITY WRAPPER

(75) Inventor: Thomas Nilsson, Malmö (SE)

(73) Assignee: MW Security AB, Malmo (SE)

( * ) Notice: Subject to any disclaimer, the term of this patent is extended or adjusted under 35 U.S.C. 154(b) by 500 days.

(21) Appl. No.: 11/582,717

(22) Filed: Oct. 17, 2006

(65) Prior Publication Data

US 2007/0069529 A1 Mar. 29, 2007

(30) Foreign Application Priority Data

Oct. 2, 2003 (EP) ..... 6121629
Jun. 21, 2006 (EP) ..... 06115819

(51) Int. Cl.
*E05B 73/00* (2006.01)

(52) U.S. Cl. ..... 70/18; 70/49; 70/57.1; 70/276; 242/382; 242/382.1; 242/382.4; 340/572.9

(58) Field of Classification Search ..... 70/18, 70/30, 49, 57.1, 63, 233, 276, 413, 14, 58, 70/DIG. 9; 242/382, 382.1, 382.4, 396.4; 340/572.9, 571, 568.1, 568.2, 568.3, 572.6, 340/542

See application file for complete search history.

(56) References Cited

U.S. PATENT DOCUMENTS 596,237 A * 12/1897 Damon ..... 70/18
5,140,836 A 8/1992 Hogan et al.
5,144,821 A * 9/1992 Ernesti et al. ..... 70/159
5,408,212 A * 4/1995 Meyers et al. ..... 340/427
5,437,172 A * 8/1995 Lamy et al. ..... 70/57.1
5,571,253 A * 11/1996 Blackburn et al. ..... 180/282
5,722,266 A 3/1998 Yeager et al.
6,015,110 A * 1/2000 Lai ..... 242/388.1
6,550,293 B1 * 4/2003 Delegato et al. ..... 70/59
6,755,055 B2 * 6/2004 Sedon et al. ..... 70/57.1
7,007,523 B2 * 3/2006 Belden, Jr. ..... 70/57.1
7,292,149 B2 * 11/2007 Yasur et al. ..... 340/573.1
7,481,086 B2 * 1/2009 Fawcett et al. ..... 70/57
2005/0172682 A1 * 8/2005 Holmgren ..... 70/57.1
2006/0027520 A1 * 2/2006 Belden, Jr. ..... 215/302
2006/0053845 A1 * 3/2006 Benda et al. ..... 70/18
2007/0240460 A1 * 10/2007 Marsilio et al. ..... 70/57.1
2008/0251623 A1 * 10/2008 Goldstein et al. ..... 242/382
2008/0289372 A1 * 11/2008 Rendon et al. ..... 70/57.1

FOREIGN PATENT DOCUMENTS

DE 28 07 650 8/1979
WO WO 2006/040693 A2 4/2006

* cited by examiner

*Primary Examiner*—Lloyd A Gall
(74) *Attorney, Agent, or Firm*—Merchant & Gould P.C.

(57) ABSTRACT

A security device comprising a retaining member forming an adjustable loop, including a cable; a ratchet member connected to the cable, operable to narrow the loop and to prevent widening of the loop, including a first main part comprising a gear ring extending in a first plane with a saw tooth profile raised from the plane, a second main part, rotatable relative to the first main part, including a latch member biased towards the first plane to engage the gear ring, and a drum for winding up of the cable.

16 Claims, 9 Drawing Sheets

SECTION A-A

SECURITY WRAPPER

FIELD OF THE INVENTION

The invention relates to a device for securing goods. Specifically, the invention relates to an adjustable device where cables are wrapped around the goods and includes a ratchet member that tightens the cables around said goods.

BACKGROUND TO THE INVENTION

Theft and unauthorized tampering of goods is a constant threat to retail stores. Today, it is very difficult to protect boxes that contain goods from being opened and the content of the box from being removed by an unauthorized person. When protecting goods, one must balance the grade of security with cost and appealing looks, i.e. consumers want to be able to see the contents of a package before buying a package. It is well known to use a number of solutions in order to protect goods and to display the contents at the same time, such as lockable transparent boxes. This solution provides means to protect a package or a box from being opened by an unauthorized person. However, this solution requires that the transparent boxes have certain dimensions relating to certain goods and in some cases goods with unusual dimensions will require specially made boxes or boxes that are over dimensioned resulting in a waste of space. It is therefore desired an adjustable device that secures goods and is adjustable to different sizes of the goods.

U.S. Pat. No. 5,722,266 discloses a security device that includes a plurality of wires or cables which encircle and lock all six sides of a box or the similar. The cable extends between a ratchet member which includes a gear with a plurality of teeth and a one-way pawl which engages the teeth, and a locking member remote from the ratchet member which includes a fastener which snap-fits to a base and requires an unlocking tool to unlock. The device is adjustable to tighten around different sizes of the goods to be protected. However, the device is complex in terms of construction and operation.

It is therefore the objective of the present invention to provide a security device that is simple in the construction and in operation wherein no extra tool is required to tighten the security device.

SUMMARY OF THE INVENTION

An overall object of the invention is therefore to provide a simplified construction for a security device which includes a ratchet member and one or more cables to be placed around an item to be protected.

The security device of the present invention fulfills this object by means of a security device comprising a retaining member forming an adjustable loop, including a cable; a ratchet member connected to the cable, operable to narrow the loop and to prevent widening of the loop, including a first main part comprising a gear ring extending in a first plane with a saw tooth profile raised from the plane, a second main part, rotatable relative to the first main part, including a latch member biased towards the first plane to engage the gear ring, and a drum for winding up of the cable.

Further the second part of the device may comprise two latch members which are spaced apart in a second plane parallel to the first plane.

Additionally the second part of the security device may comprise two latch members which are diametrically spaced apart over the gear ring.

In one embodiment the second part of the security device comprises two latch members which are biased towards the first plane to engage the gear ring and separately operable to disengage from the gear ring.

Further the latch member of the security device is configured to disengage from the gear ring by magnetic attraction of the latch member in a direction perpendicular to the first plane.

Additionally, the security device comprises a maneuver member connected to the second main part, having an inner side facing the gear ring and carrying the latch member, and an outer side carrying an interface for a tool for disengaging the latch from the gear ring. In an additional embodiment the maneuver member of the security device carries two spaced apart latch members, and a central gripping portion between the latch members for connection to a complementary gripping portion of the tool.

The latch member of the security device may comprise a magnetically attractable leaf spring, having an edge portion which in a rested state is engaged with the gear ring.

Further, the latch member of the security device comprises a sheet of a magnetically attractable metal disposed in a second plane parallel to the first plane, wherein a substantially U-shaped slot is formed in the sheet such that a leaf spring is formed, which leaf spring is bent out at an angle from the second plane towards the first plane. The leaf spring may be curved in the second plane to follow the annular extension of the saw tooth profile.

Further, the retaining member of the security device includes two cables, and a support member connected to the two cables remote from the ratchet member.

Additionally, the cable of the security device extends between two end portions which are both connected to the drum.

The retaining member of the security device may include a support member, connected to the cable remote from the ratchet member and having a layer of rubber-like material arranged on a surface configured to face a goods when retained by the security device.

In an embodiment of the invention a layer of rubber-like material is arranged on a surface of the ratchet member configured to face a goods when retained by the security device. In a further embodiment of the security device, the ratchet member comprises an alarm circuit connected to the cable, configured to sound an alarm when the cable is cut off. The security device may further comprise an electronic article surveillance (EAS) tag.

BRIEF DESCRIPTION OF THE DRAWINGS

The invention will be described in more detail below with reference to examples of embodiments and with reference to the attached drawings, of which

DETAILED DESCRIPTION OF EMBODIMENTS OF THE PRESENT INVENTION

Figure 1:
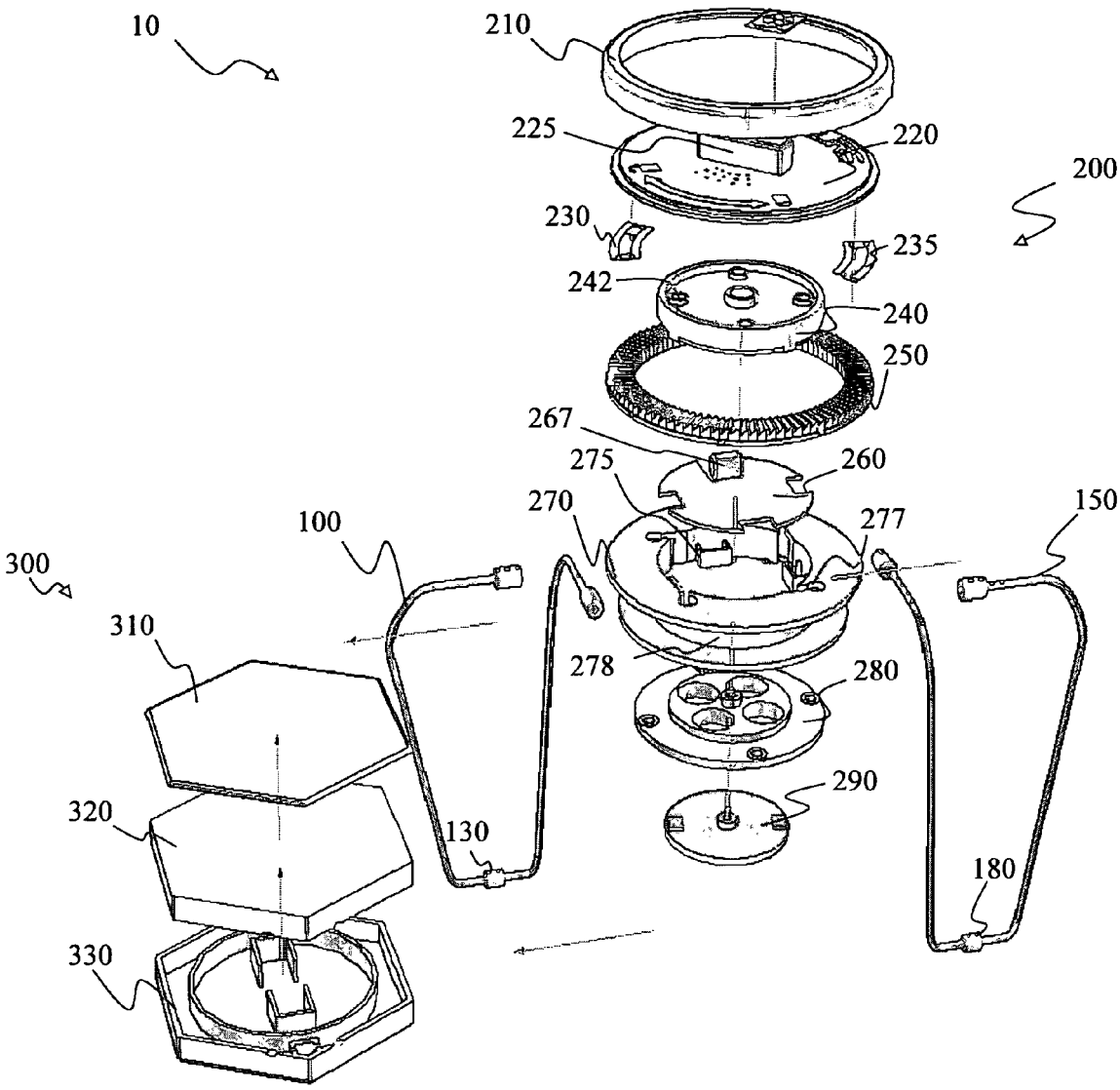
FIG. 1 is an exploded perspective view of an embodiment of the invention.
Figure 2:
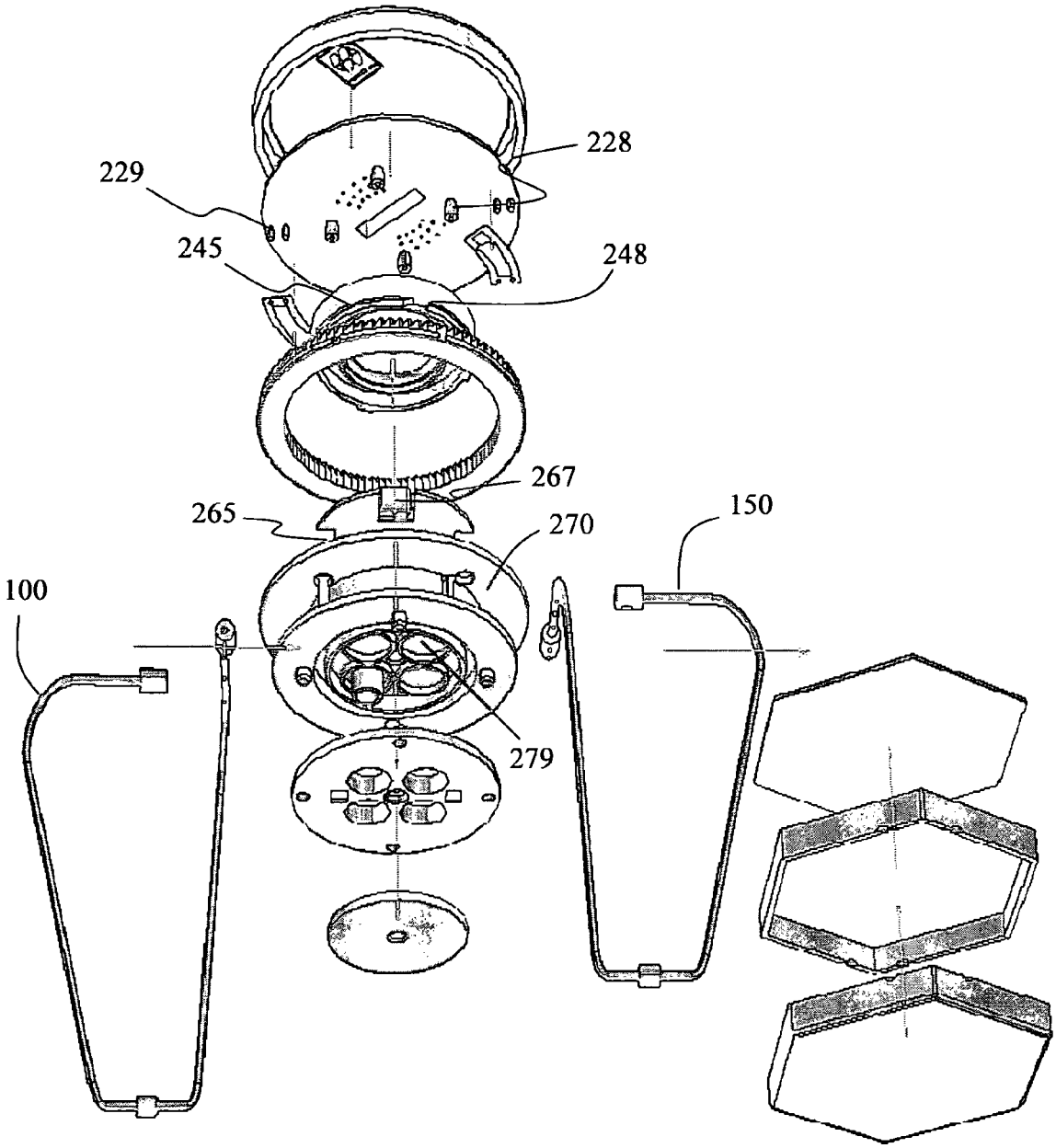
FIG. 2 is an exploded perspective view from a different angle of an embodiment of the present invention.

Referring to FIGS. 1 and 2, exploded views of an embodiment of the present invention are shown, wherein the security device in general is denoted as 10. The security device 10 comprises a ratchet member 200, retaining member 100,150 connected to the ratchet member 200, and a support member 300 connected to the retaining member 100,150 remote from the ratchet member 200. The main objective of the security device is to tighten the retaining member 100,150 around goods to be protected. The retaining member forms one or more adjustable loops and may comprise one or a number of cables, in the illustrated example specifically two cables 100, 150 that are adjustable around goods to be protected. The ratchet member 200 of the security device connected to the cable, operable to narrow the loop and to prevent widening of the loop, includes a first main part comprising a gear ring 250 extending in a first plane with a saw tooth profile raised from the plane, and a second main part, rotatable relative to the first main part, which includes a latch member 230, 235 biased towards the first plane to engage the gear ring 250, and a drum 270 for winding up of the cable. The second part of the device may comprise two latch members 230, 235 which are spaced apart in a second plane parallel to the first plane.

In an embodiment of the invention the two latch members are diametrically spaced apart over the gear ring 250. However, the number of latch members as well as the spacing between the latch members may vary depending on what detacher to use.

In one embodiment the two latch members 230, 235 are biased towards the first plane to engage the gear ring 250 and separately operable to disengage from the gear ring 250. Further, the latch members 230, 235 of the security device 10 are configured to disengage from the gear ring 250 by magnetic attraction of each latch member 230, 235 in a direction perpendicular to the first plane. This magnetic attraction that releases the latch members from the gear ring 250 is typically produced by a universal detacher or the like.

Additionally, the security device 10 comprises a maneuver member 220 connected to the second main part, having an inner side facing the gear ring 250 and carrying the latch member 230, 235, and an outer side carrying an interface for a tool for disengaging the latch from the gear ring, the tool typically being a detacher. In an additional embodiment the maneuver member 220 of the security device carries the two spaced apart latch members 230, 235, and a central gripping portion 225 between the latch members for connection to a complementary gripping portion of the tool. The gripping part 225 may be recessed in the maneuver 220 member or, as in the illustrated example, protruding from the maneuver member 220.

The latch member 230, 235 of the security device 10 may comprise a magnetically attractable leaf spring, having a tongue with an edge portion 233, 238 which in a rested state is engaged with the gear ring 250. An alternative embodiment of the latch member 230, 235 may be a magnetic elongated pin with a resilient base part that is retractable from it protruding resting state when a magnetic force is applied to the security device. However, the illustrated latch member 230, 235 of the security device comprises a sheet of a magnetically attractable metal disposed in a second plane parallel to the first plane, wherein a substantially U-shaped slot is formed in the sheet such that a leaf spring is formed, which leaf spring is bent out at an angle from the second plane towards the first plane. In an embodiment of the present invention the leaf spring is curved in the second plane to follow the annular extension of the saw tooth profile in order to center the point wherein the latch member 230, 235 engages teeth of the gear ring 250. However, the leaf spring may be rectangular in order to facilitate the manufacturing of the leaf spring.

In the embodiment, wherein the retaining member 100, 150 of the security device includes two cables, the cables extend between two end portions which are both connected to the drum 270 of the device.

The security device may include a support member 300 connected to the cable 100, 150 remote from the ratchet member 200 and having a layer of a high friction material, such as a rubber-like material 310 arranged on a surface configured to face a goods when retained by the security device. In an embodiment of the invention a layer of rubber-like material is also arranged on a surface of the ratchet member 200 configured to face a goods when retained by the security device. The object of the rubber like material is to increase the friction force between the ratchet/support member and the goods in order to obstruct the different members to be pulled off the goods.

A more detailed description of the embodiment illustrated in FIGS. 1-7 will now be outlined, in which the ratchet member of the security device comprises a first main part and a second main part, which are rotatable with respect to each other to be operable to wind up and thereby tighten the cable. Both the first main part and the second main part of the ratchet member 200 comprises a number of sub units in order to be lockable.

Figure 8:
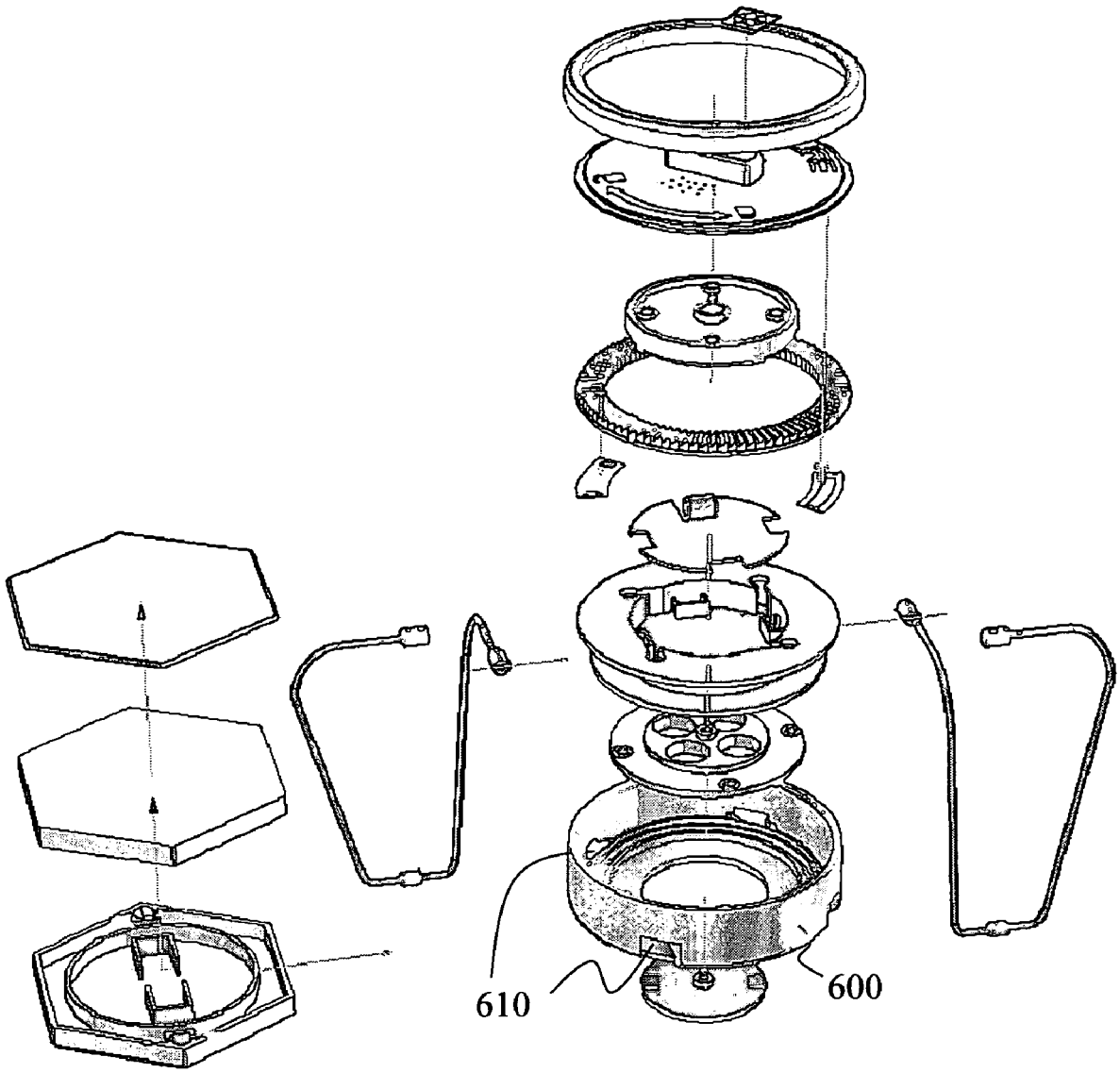
FIG. 8 is an exploded perspective view of an embodiment of the invention.

A main member of the first main part is the gear ring 250, and a main member of the second main part is the maneuver member 220 with latch members 230, 235 secured thereon for interaction with the gear ring. The latch members are preferably firmly attached to an inner surface of the maneuver member 220, and an outer surface of maneuver member 220 is arranged with a gripping part 225 by means of which the user may tighten the security device 10 around goods. In order to enhance operability, and increase safety, an outer casing is preferably also provided, such as an outer ring 210 disposed over and about the periphery of maneuver member 220. Outer ring 210 is preferably welded or glued to the periphery of gear ring 250, whereby the maneuver member 220 with its latch members 230, 235 are fixed between the gear ring 250 and the outer ring 210. In an alternative embodiment, as shown in FIG. 8, the first member also includes a casing 600 substantially enclosing the second main part entirely, and having apertures for the cables. When operating the security device for tightening the cables around an object, one hand may be held on outer ring 210, or casing 600, whereas the maneuver member 220 may be rotated by the other hand. When the cables are placed around an object it is in fact not necessary to hold on to the first main part, but the grippable outer ring 210 or casing 600 increases operability in terms of stability in the tightening process.

Figure 4:
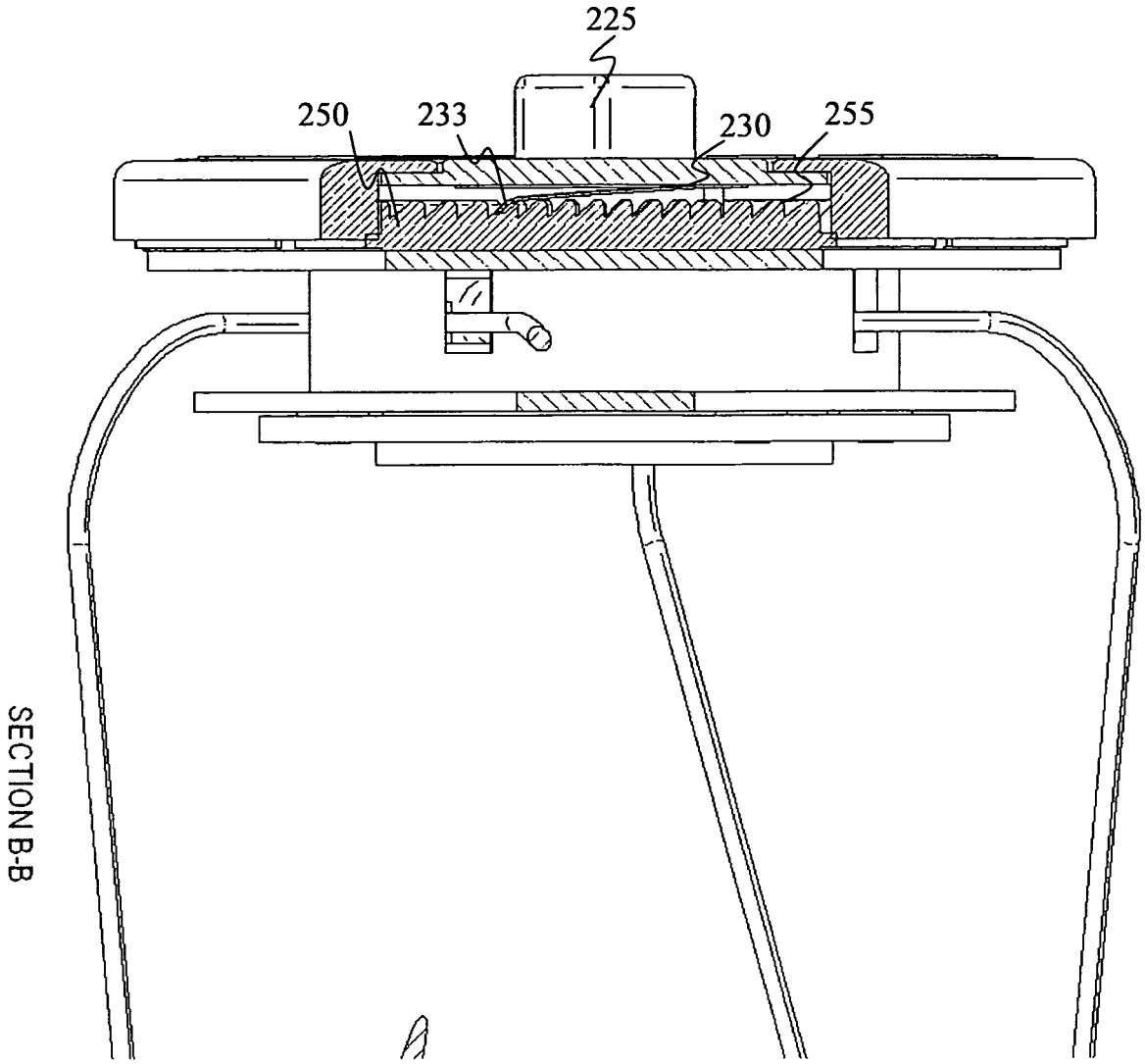
FIG. 4 is a sectional view of the security device taken along line B-B in FIG. 3.
Figure 5:
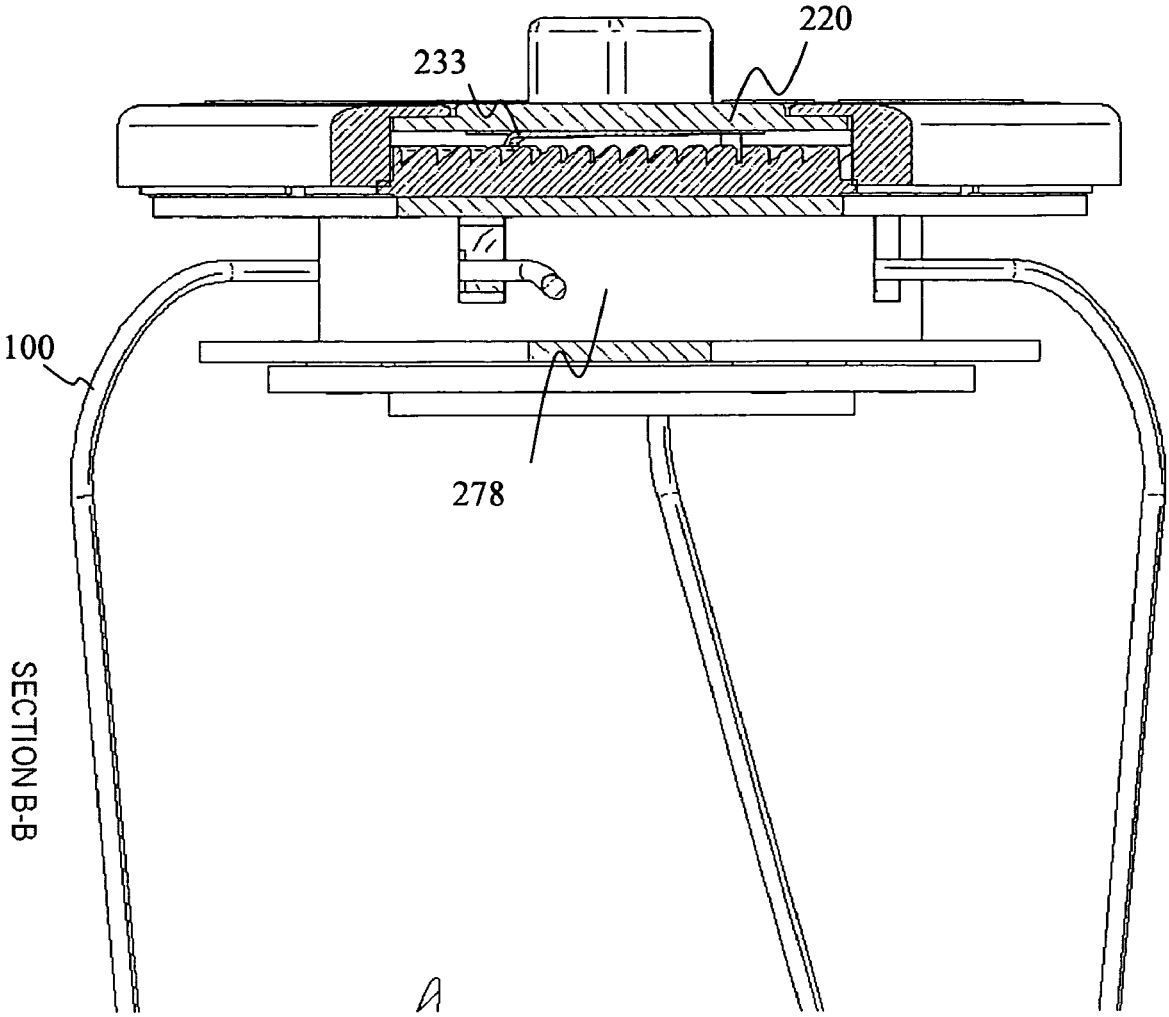
FIG. 5 is a sectional view of the security device wherein the latch member is not in a locking state taken along line B-B in FIG. 3.
Figure 6:
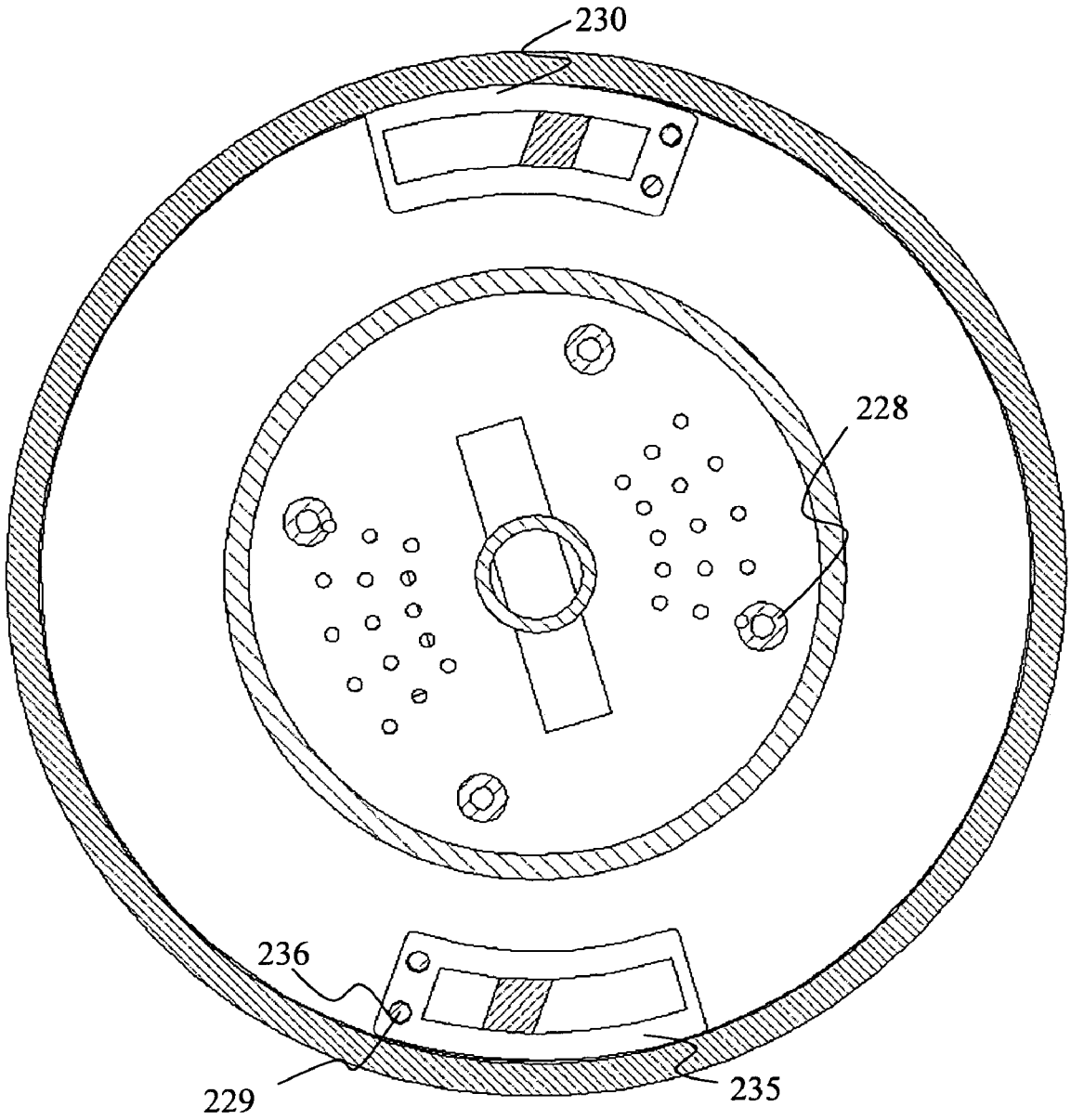
FIG. 6 is a sectional view of the security device taken along line A-A in FIG. 3.

The latch members comprise protruding tongues 233, 238 that are arranged to engage teeth arranged in gear ring 250. In one embodiment of the invention, each latch member 230, 235 is composed of a sheet of a resilient magnetically attractable metal, such as magnetic steel, in which a substantially U-shaped slot is formed to provide the tongue 233, 238. In its rested position, the tongue is slightly bent out from the main plane of the sheet. As such, the tongue 233, 238 may either be substantially straight and extend at an acute angle to the main plane of the sheet, or it may be curved such that an outer tip of the tongue projects from the main plane, as shown in FIGS. 4 and 5. When the security device 10 is tightened, the tongues 233,238 follow flexibly over the teeth of the gear ring 250 of the first main part of the ratchet member 200 thereby moving in one direction and secures that the security device 10 is not able to be unwind by not being able to turn in the other direction. As best seen in FIG. 6, the latch member preferably has a slightly curved shape within its main plane, where the curvature is defined by the radial distance to the centre of rotation of maneuver member 220. This way, the point of engagement between tongues 233, 238 and gear ring 250 will be located at the periphery of the device, allowing small gear steps. Thereby, it is easy to tighten the cables even when they are in tension, making it easy to tightly secure goods. As seen in e.g. FIG. 6, the maneuver member 220 comprises protruding pins 229 that are arranged be inserted into holes 236 arranged in the latch members 230, 235, thereby securing the latch members 230, 235 to the maneuver member 220 by a snap-lock. Alternatively, the latch members may be glued to or integral with maneuver member 220.

The second main part of the ratchet member 200 further comprises a drum 270 for winding up the cable or cables, and a winding portion 240 connecting the maneuver member 220 to the drum 270. The inner surface of the maneuver member 220 is provided with a number of protruding portions 228 to secure the maneuver member 220 to the winding portion 240 by inserting the protruding portions 228 into recesses 242 arranged in the winding portion 240. The winding portion 240 of the device is further arranged with grooves 245 along the lower edges of its envelope surface. The end surfaces of the grooves are formed to provide engagement surfaces, or shoulders, 248 arranged to engage with the drum 270 or directly with the cable ends in order to be able to rotate the drum 270 by turning the gripping part 225 of the ratchet member 200.

The device 10 may include one or more cables, and the illustrated embodiments comprise two cables 100, 150, which is a best mode of operation at least for box-like goods. For goods having a waist portion, only one cable may be sufficient, whereas more complex shapes of goods may in fact require more than two cables.

The cable ends are preferably provided with a head portion of increased width, as shown in the drawings. In drum 270, each cable end is arranged in a fastening position by securing the ends in stables 275. The winding portion 240 is arranged to be immersed, at least partially, into the drum 270 in order to be able to engage the stables 275 that secures the cables 100, 150 to the drum 270 with the shoulders 248 of the winding portion 240. In an embodiment of the invention the drum comprises a number of key-hole type slots 277, wherein ends of the cables 100, 150 are able to get inserted through a substantially circular part of the slots and then folded down into stables 275, when assembling the security device 10. It should be noted that the cables in the illustrated example are looped and have both ends secured in the drum 270. More specifically, the cables run from the drum 270, through the support member 300, and back to the drum, in which both cable ends are secured. However, an alternative choice may of course be to allow one cable to run from the ratchet member 200 to the support member, and then another cable back from the support member 300 to the ratchet member 200. This is not relevant to the invention though. When the security device 10 is tightened, the drum 270 is rotated by the winding portion 240 and the cables are reeled in along the cylindrical circumferential surface 278 of said drum 270.

In the illustrated embodiment an intermediate alarm plate 260 is arranged to determine when a cable 100, 150 is cut off or the like. The intermediate alarm plate 260 is in contact with the cables forming a power circuit and when the power circuit is broken, e.g. when one of the cables is cut or the like, the intermediate alarm plate sounds an alarm. The cables are therefore connected to the plate and in the illustrated embodiment a capacitor 267 configured to sense a cutoff of any one of the cables is shown. The intermediate alarm plate is arranged in the bottom of the drum 270 and is provided with slots 265 arranged to accommodate the stables 275 of the drum.

Below the drum 270 one or more power elements are provided, such as batteries or the likes, to supply power to the intermediate alarm plate 260. In order to store these power elements the lower side of the drum 270 is preferably provided with a number of grooves and cavities 279. The power is supplied to the intermediate alarm plate via e.g. a conductive channel embedded through the drum 270 or the like. In an embodiment of the invention a battery plate 280 may also be arranged below the drum 270 and a closure plate 290 is arranged under the battery plate closing of the cavities arranged for the power elements. The closure plate is preferably screwed through a centre hole of battery plate 280, drum 270, alarm plate 260 and into secure engagement with winding portion 240. The screw (not shown) will only be accessible for removal when the security device 10 is free from goods.

In e.g. FIGS. 1-3 and 8 a support member 300 is shown. The support member 300 preferably comprises a housing section 330 that contains a device, such as an electronic article surveillance tag, which device is arranged to set off an alarm when passed through a central store alarm, such as columns in an (EAS) system or the likes. The housing section 330 further comprises a number of fastening elements for fastening the cables via protruding sections 130, 180 arranged on the cables. It should be understood that the length of the cables may vary.

Additionally, the housing section 330 is sealed off by a top section 320 of the support member 300. On top of the top section 320 is a layer 310 of high friction provided, typically a rubber-like material such as rubber, silicon or the like. The layer 310 is provided to the housing section in order to grab the surface of the goods that the security device 10 is wrapped around in a manner that makes it more difficult to pull the security device off from the goods. It should also be understood that a similar layer may be provided to the surface of the ratchet member 200 facing the good to be protected, e.g. on the closure plate 290 or the casing 600.

Now, referring to the drawings, the function of the security device will be described in order to clarify the invention. The cables 100, 150 are wrapped around goods that is intended to be protected from theft. The ratchet member 200 is turned in order to tighten the cables around the goods. Referring back to FIG. 1, the ratchet member 200 is turned by twisting the gripping part 225 arranged of the maneuver member 220, thereby rotating the latch members along the gear ring 250. Following the maneuver member 220 is also the winding portion 240. The winding portion 240 in its turn forces the drum 270 to turn as well, rotating the core of the ratchet member. The drum 270 having the cables fastened inside pulls the cables 100, 150 in through openings 610 of a casing 600 of said security device 10 (only shown in exploded view in FIG. 8). The gripping part 225 is turned until the cables are enough tightened around the goods and the rubber padded support member 320 is arranged tightly against said goods.

Referring to FIG. 4, a sectional view in part cross section of the security device 10 is shown. In the illustrated example the latch member 230 is in an engaged state, which means that the tongue 233 of the latch member is engaged with the teeth 255 of the gear ring 250. When the gripping part 225 is turned counter clockwise the tongue 233 will follow along the tilted teeth 255. However, if a force is applied to the gripping part trying to turn the gripping part clockwise the tongue 233 will be forced against the engaging side, the vertical side, of the tilted tooth preventing the gripping part to move. It should be understood that the side of the tooth that prevents the tongue 233 to pass can be in any shape as long as it prevents the tongue to move in that direction. In this manner the security device can only be tightened around the goods as long as the latch member 233 is in engagement with the gear ring 250.

Referring to FIG. 5, a sectional view of the security device is shown, wherein the security device is in an unlocked state, i.e. the cables can be unwind and pulled out from the drum 270 and thereby enabling the goods to be unwrapped of said security device 10. To position the security device into an unlocked state, the security device needs to be exposed to a magnetic force. This magnetic force is applied to the security device 10 by permanent magnets arranged in a so called detacher. This is done by bringing the detacher towards the upper side of the security device, i.e. against the surface of the maneuver member 220 arranged with the gripping part 225, thereby, bringing the magnets against the maneuver member 220 and forcing the tongue 233,238 of the latch members by the magnetic force from the magnets from the engaged state (see FIG. 4) into the unlocked state (see FIG. 5). The tongue 233 of the latch member is in the unlocked state brought against the maneuver member 220 of the security device 10 and thereby enabling the rotatable parts of the security device 10 to be turned in a loosening direction, i.e. in the illustrated example clock wise. This means that the loosening of the cables around the goods is done either by turning the detacher or the goods.

The maneuver member 220 is preferably formed to fit with its gripping part in a recess of existing detachers for security boxes. It should be noted that the maneuver member 220 should be that thin that the magnetic force of the detacher may force the latch members 230, 235 into a horizontal configuration. In an embodiment of the invention the protruding edge 233, 238 is forced to a minor vertical movement, not necessarily rendering the latch element into a full horizontal configuration, but enough to disengage the tongue 233, 238 from the teeth 255 of the gear ring 250. The latch member should, in order to fit an existent detacher, be spaced apart with a diametrical distance of 40 mm-60 mm from center to center of the latch members.

Figure 3:
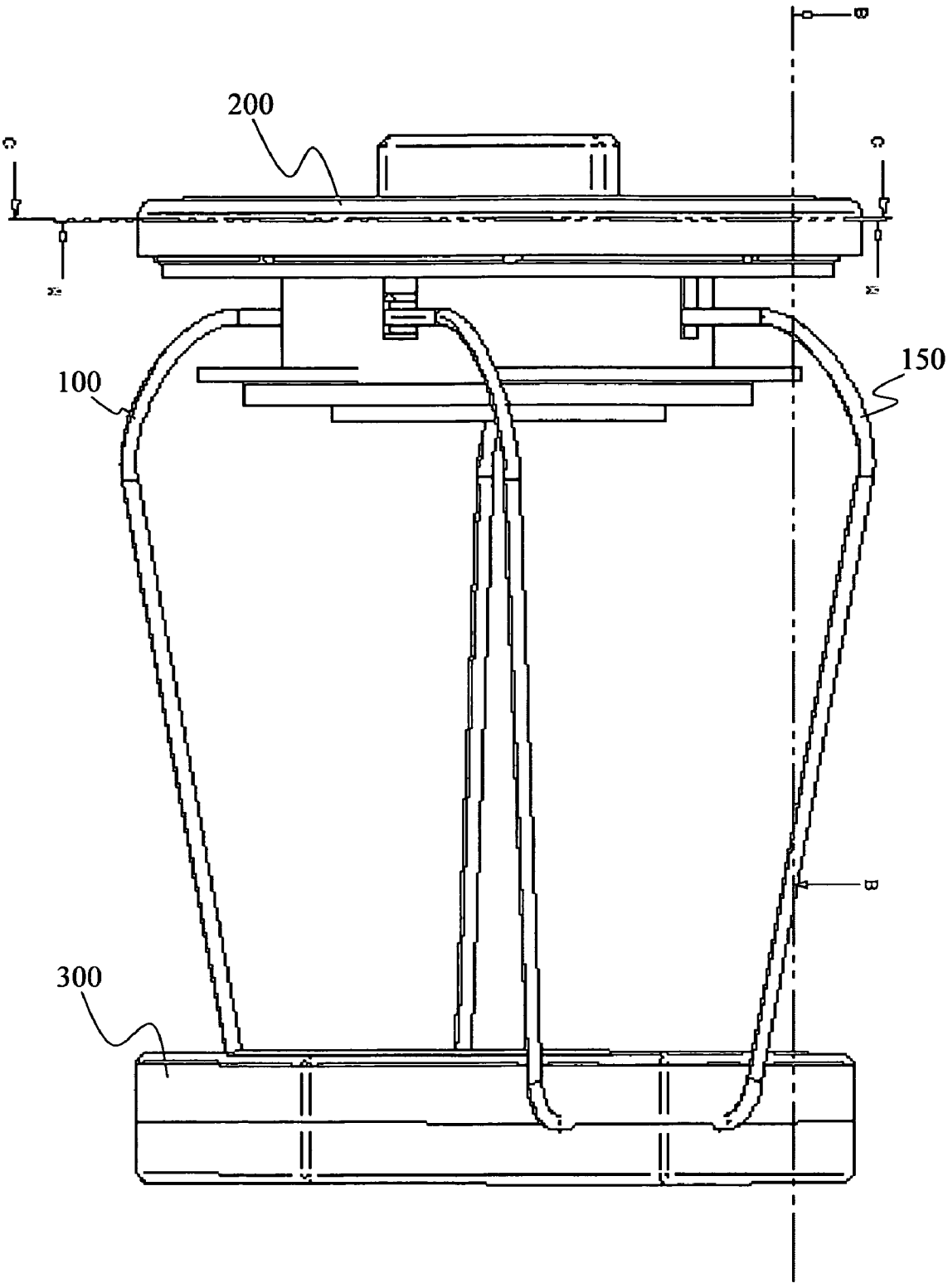
FIG. 3 is a side view of an embodiment of the invention.
Figure 7:
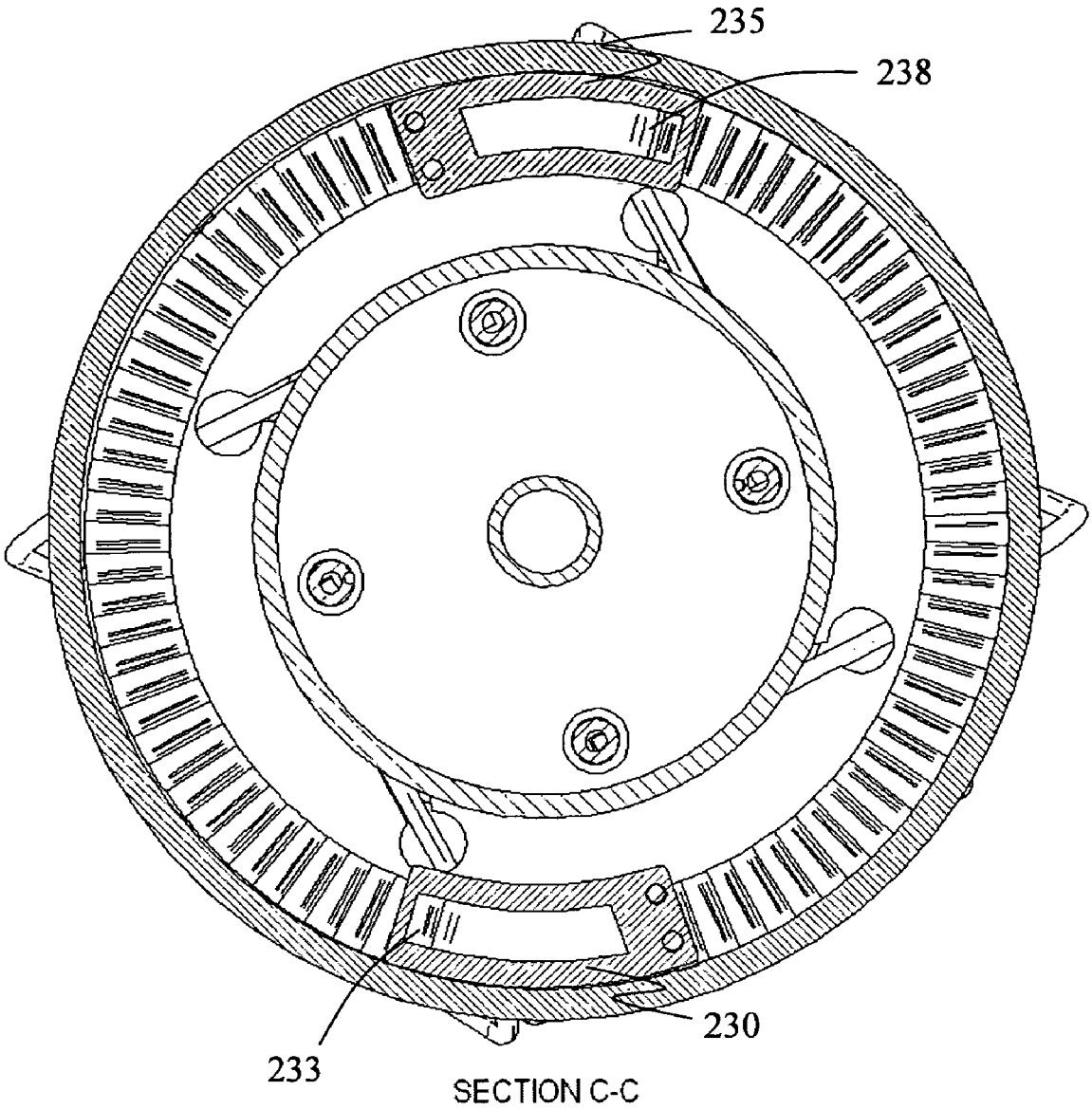
FIG. 7 is a sectional view of the security device taken along line C-C in FIG. 3.

FIGS. 6 and 7 shows the latch members 230, 235 in a mounted state along the lines A-A and C-C of FIG. 3. The latch members are arranged opposite each other at a diametrical distance corresponding to the diameter of the gear ring 250 as well as placement of magnets in an existing detacher in order to use a universal detacher to unlock the security device 10. It should be understood that the number of latch members may be increased.

FIG. 8 discloses an exploded view of the security device 10 and differs from what FIG. 1 shows in the matter of the casing 600 that is not included in FIG. 1. In the security device 10 the core of the ratchet member is rotatable in order to reel in the cables 100, 150. However, the gear ring 250 and the casing 600 are not turnable rendering the tightening and loosening of the cables possible. In the casing 600 a number of grooves are provided, arranged to accommodate different sections of the ratchet member 200. The rotatable second main part of the ratchet 200 is laid on top of these grooves and the gear ring 250 is fastened to the casing enabling an internal winding mechanism to be able to reel up the cables 100, 150 into the housing portion 270 of the ratchet member 200.

The gear ring 250 may be secured to the casing 600 by using a snap lock, such as recesses arranged in the gear ring 250 and corresponding protruding pins arranged in the casing 600 to snap lock into said recesses. The casing 600 may in one embodiment be welded together using e.g. ultrasonic welding or the like. The gear ring 250 may also be secured to the outer ring 210, e.g. by gluing it to the ring, and the casing 600 may be secured to the outer ring 210 also by gluing it to the ring. However, in another embodiment the gear ring 250 is glued to the casing 600 and the outer ring 210 is glued or ultrasonically welded to the casing 600 as well. It should also be understood that the casing 600 is optional and in an embodiment without the casing, the gear ring 250 is secured to the outer ring 210 with an uncovered drum 270.

The assembly of an embodiment of the invention will now be described with reference to FIG. 1, 2 and 8. The alarm plate 260 is immerged into the drum 270. The cables are inserted first through the openings 610 of the casing 600 and then further inserted through the slots 277 of the drum 270. The headed ends are first inserted through the round part in vertical direction and then slid down to the stables 275. The ends of the cables 100, 150 are then secured in the stables 275 of the drum. The cables may be in contact with the alarm plate either through the stables 275 or just arranged against the alarm plate 260. The batteries are then provided to the drum 270 by being arranged in the battery plate 280 that is secured to the drum 270, e.g. by a snap fit lock or a screwing arrangement. The assembly consisting of the drum 270 with the alarm plate 260 and the cables 100, 150 and the battery plate 280 is then immerged into the casing 600 and secured therein by screwing the closure plate 290 to the battery plate 280. The gear ring 250 is then secured to the casing 600 by a snap fit lock or similar.

The latch members 230, 235 are secured to the maneuver member 220 and the winding portion 240 is also secured to the maneuver member, e.g. by screwing or snap fit or the like. The maneuver member 220, arranged with the latch members 230, 235 and the winding portion 240, is then immerged into the drum above the alarm plate registered to match the grooves of the winding portion with the stables 275 of the drum 270. When a match is made the outer ring 210 is supplied to the security device 10 to contain the winding portion 240 and the latch members 230, 235 in a suitable position in order to engage corresponding elements 275, 250. The outer ring is then secured to the casing 600, preferably by welding them together. It should here be noted that when the security device has sounded its alarm it may only be silenced by removing its power supply, e.g. batteries. Hence, the security device may only be silenced by unscrewing of the closure plate 290.

The support member 300 is assembled by snap fitting the protruding sections 130, 180 of the cables into stables or the like arranged in the housing section 330 and arranging an EAS tag in the housing section 330. The housing section is closed off by a top section 320 fastened to the housing section e.g. by a snap lock fit, fastening elements, gluing, welding or the like. The housing section 330 and the top section have in an embodiment of the invention recesses in the circumferential sides arranged to fit the cables 100, 150. The illustrated support member 300 is in hexagonal shape but may be in any suitable shape, such as circular, rectangular or the like. It should also be understood that the EAS-tag may be contained in the ratchet member 200.

Finally, when the cables 100, 150 are secured in the housing section 330 and the housing section is sealed off by the top section 320, the rubber like layer 310 is provided to the top section 320, either by gluing it, welding it or the like, to the top section 320. This may also be done in a separate process, whereby the top section 320 and the rubber-like layer 310 are assembled before secured to the housing section.

Figure 9:
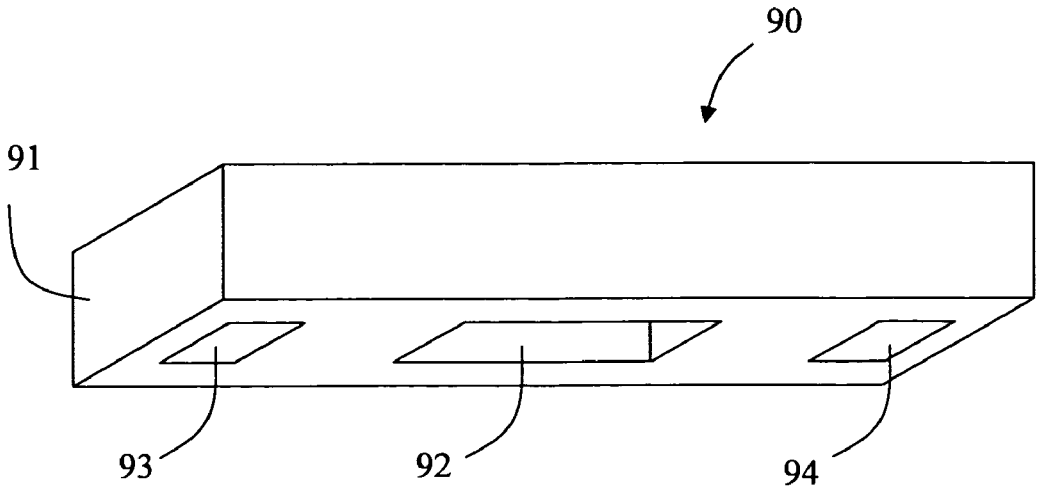
FIG. 9 schematically illustrates a detacher for use with a security device according to an embodiment of the invention.
Figure 10:
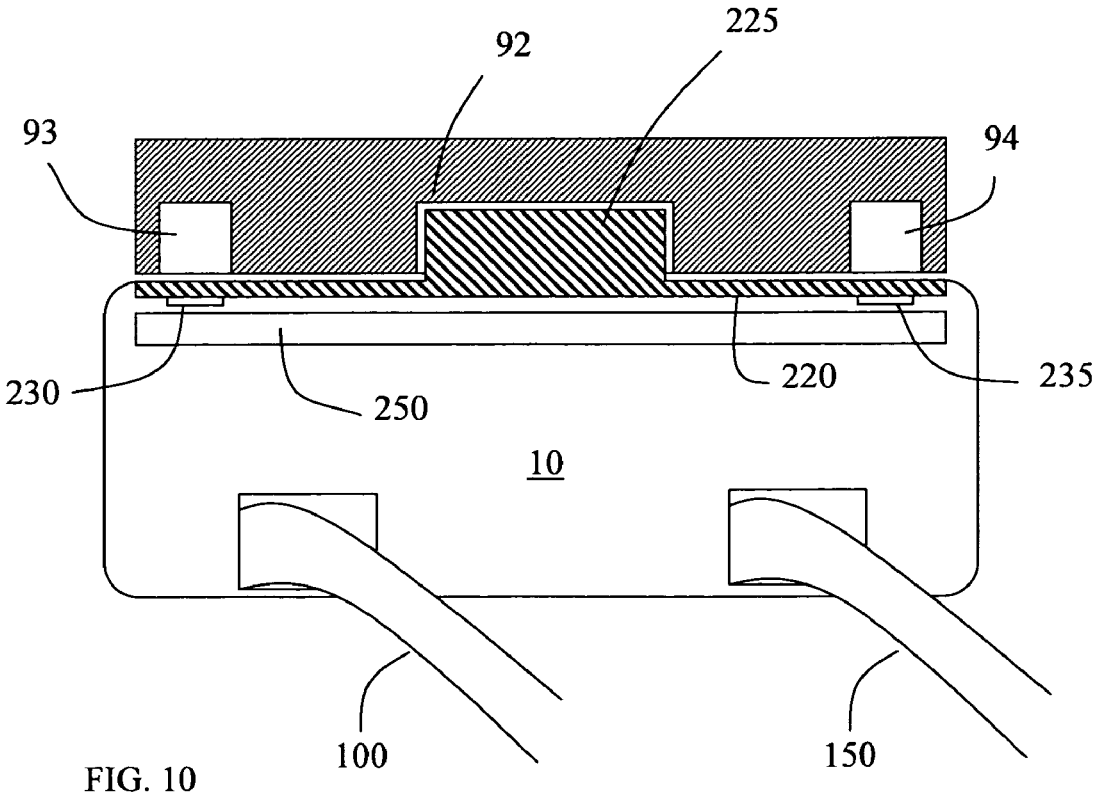
FIG. 10 schematically illustrates engagement of the detacher with a security device according to an embodiment of the invention for unlocking the security device.

FIGS. 9 and 10 schematically illustrate a tool for unlocking the security device, a so called detacher. In FIG. 9 the detacher 90 is shown to include a support structure 91, such as a plastic frame. The support structure defines an interface which is elongated in the illustrated preferred embodiment. However, that does not mean that the support structure as such need to be elongated, even if it is illustrated as such in the drawings. The interface includes a centre recess 92, for receiving the gripping portion 225 of maneuver portion 220. Furthermore, a pair of strong permanent magnets 93 and 94, respectively, are fixed at opposing sides of recess 92.

In FIG. 10, a schematic representation is disclosed of the detacher 90 applied onto a security device 10 according to an embodiment of the invention. Recess 92 is shaped to accommodate gripping portion 225, preferably only in one or in two opposite orientations. By placing the detacher 90 onto the gripping portion 225, magnets 93, 94 are automatically aligned over latch members 230, 235, which are thereby attracted by the magnets to disengage from gear ring 250. The second main part of the security device is thereby made rotatably free from the first main part, and cables 100 and 150 may be withdrawn from the security device 10. The detacher 90 will then rotate along with the maneuver portion 220, and will stay attached thereto by means of the magnetic force, and possibly also by a snug fit of gripping portion 225 in recess 92. Increased security may be obtained by including more than two latch members and magnets, disposed at different angles, or even at different radial distances.

I claim:

1. A security device comprising:

a retaining member forming an adjustable loop, including a cable;

a ratchet member connected to the cable, operable to narrow the loop and to prevent widening of the loop, including a first main part comprising a gear ring extending in a first plane with a saw tooth profile raised from the plane, a second main part, rotatable relative to the first main part, including a latch member tongue biased towards the first plane to engage the gear ring, and a drum for winding up of the cable, wherein the latch member tongue is curved at an outer edge portion towards the first plane.

2. The security device of claim 1, wherein the second part comprises two latch member tongues which are spaced apart in a second plane parallel to the first plane.

3. The security device of claim 1, wherein the second part comprises two latch member tongues which are diametrically spaced apart over the gear ring.

4. The security device of claim 1, wherein the second part comprises two latch member tongues which are biased towards the first plane to engage the gear ring and separately operable to disengage from the gear ring.

5. The security device of claim 1, wherein the latch member tongue is configured to disengage from the gear ring by magnetic attraction of the latch member tongue in a direction perpendicular to the first plane.

6. The security device of claim 1, comprising a maneuver member connected to the second main part, having an inner side facing the gear ring and carrying the latch member tongue, and an outer side carrying an interface for a tool for disengaging the latch member tongue from the gear ring.

7. The security device of claim 6, wherein the maneuver member carries two spaced apart latch member tongues, and a central gripping portion between the latch member tongues for connection to a complementary gripping portion of the tool.

8. The security device of claim 1, wherein the latch member tongue comprises a magnetically attractable leaf spring, having an edge portion which in a rested state is engaged with the gear ring.

9. The security device of claim 1, wherein the latch member tongue comprises a sheet of a magnetically attractable metal disposed in a second plane parallel to the first plane, wherein a substantially U-shaped slot is formed in the sheet such that a leaf spring is formed, which leaf spring is bent out at an angle from the second plane towards the first plane.

10. The security device of claim 9, wherein the leaf spring is curved in the second plane to follow an annular extension of the saw tooth profile.

11. The security device of claim 1, wherein the retaining member includes two cables, and a support member connected to the two cables remote from the ratchet member.

12. The security device of claim 1, wherein the cable extends between two end portions which are both connected to the drum.

13. The security device of claim 1, wherein the retaining member includes a support member, connected to the cable remote from the ratchet member and having a layer of rubber-like material arranged on a surface configured to face a goods when retained by the security device.

14. The device of claim 1, wherein a layer of rubber-like material is arranged on a surface of the ratchet member configured to face a goods when retained by the security device.

15. The security device of claim 1, wherein the ratchet member comprises an alarm circuit connected to the cable, configured to sound an alarm when the cable is cut off.

16. The security device according to claim 1, comprising an electronic article surveillance (EAS) tag.

* * * * *